US010494819B1

(12) United States Patent
Murphy et al.

(10) Patent No.: US 10,494,819 B1
(45) Date of Patent: Dec. 3, 2019

(54) JOINER CLIP

(71) Applicant: Exterior Research and Design, L.L.C., Seattle, WA (US)

(72) Inventors: Colin Ruark Murphy, Seattle, WA (US); Darbi Sovay Krumpos, Seattle, WA (US)

(73) Assignee: Exterior Research and Design, L.L.C., Seattle, WA (US)

( * ) Notice: Subject to any disclaimer, the term of this patent is extended or adjusted under 35 U.S.C. 154(b) by 0 days.

(21) Appl. No.: 16/006,290

(22) Filed: Jun. 12, 2018

(51) Int. Cl.
*E04F 13/08* (2006.01)
*E04B 2/74* (2006.01)

(52) U.S. Cl.
CPC ..... *E04F 13/0844* (2013.01); *E04F 13/0801* (2013.01); *E04F 13/0823* (2013.01); *E04B 2002/7475* (2013.01)

(58) Field of Classification Search
CPC ..... E04B 2002/7475; E04F 13/0801; E04F 13/0823; E04F 13/0869; E04F 13/0828; E04F 13/0844
See application file for complete search history.

(56) References Cited

U.S. PATENT DOCUMENTS 441,227 A * 11/1890 Cary ..... B65D 9/32 217/70
2,216,271 A * 10/1940 Joiner ..... E04D 1/34 52/547
4,127,975 A * 12/1978 Judkins ..... E04B 2/7409 52/489.2
4,296,580 A * 10/1981 Weinar ..... E04B 2/7457 52/281
4,333,286 A * 6/1982 Weinar ..... E04B 2/7457 52/281
4,448,007 A * 5/1984 Adams ..... E04F 13/0823 52/100
4,831,808 A * 5/1989 Wynar ..... E04B 9/245 52/281
4,995,605 A * 2/1991 Conville ..... E04F 13/081 52/770
5,058,358 A 10/1991 Stratton
5,564,245 A 10/1996 Rademacher
6,367,220 B1 4/2002 Krause et al.
6,725,619 B1 4/2004 Barber
7,441,382 B2 10/2008 Beck et al.
(Continued)

FOREIGN PATENT DOCUMENTS

DE 102009047415 A1 1/2011

*Primary Examiner* — Andrew J Triggs
(74) *Attorney, Agent, or Firm* — Avery N. Goldstein; Blue Filament Law PLLC

(57) ABSTRACT

A joiner clip for securing panels to a substrate is provided that includes a sheet of material that has a first portion, a second portion, a first face, and a second face. On the first face, a first anchoring cleat is located in the first portion and a second anchoring cleat is located in the second portion. A spaced guide is positioned between the first portion and the second portion of the sheet on the first face. A mounting hole is formed through the sheet and is positioned colinear with the spacer guide. A fastener from the second face secures the joiner clip and panels to a vertical stud substrate. A construction unit including the joiner clip for securing panels of material to a vertical stud substrate is also provided. A butt joint is readily formed between two secured panels.

21 Claims, 7 Drawing Sheets

(56) References Cited

U.S. PATENT DOCUMENTS

| | | | | |
|---|---|---|---|---|
| 7,748,187 | B2 | 7/2010 | Sensenig | |
| 9,200,456 | B2 * | 12/2015 | Murphy | E04F 13/0801 |
| 2004/0074188 | A1 | 4/2004 | Beck | |
| 2004/0237443 | A1 | 12/2004 | Haley | |
| 2014/0013696 | A1 * | 1/2014 | Murphy | E04F 13/0801<br>52/489.1 |

* cited by examiner

JOINER CLIP

FIELD OF THE INVENTION

The present invention in general relates to an apparatus for installing and securing panels to a frame and in particular to a joiner plate or clip designed to improve ease, efficiency, and accuracy of placement, spacing, and alignment of panels when creating butt joints between panels during installation.

BACKGROUND OF THE INVENTION

Frame construction is a quick and efficient method of constructing inner and outer walls in structures. Frames generally are formed with vertical members called studs that are joined to upper and lower horizontal members.

Traditionally, studs were made of wood, usually 2'×4" or 2"×6" dimensional lumber. In North America, studs are typically placed 16 inches from each other's center, but sometimes also at 12 inch or 24 inch intervals. Steel studs are gaining popularity, especially for non load-bearing walls. Typically, panels, siding or other types of wall materials and sheeting are secured to the fame via screws, nails, or other specialty fasteners to the studs.

Fiber cement (FC) siding most often includes overlapping horizontal boards, imitating wooden siding, clapboard and imitation shingles, or large panels simulating tongue and groove or board and batten applications. Fiber cement siding is also manufactured in a sheet form and is used not only as cladding but is also commonly used as a soffit/eave lining and as a tile underlay on decks and in bathrooms. Fiber cement siding is not only used as an exterior siding, it can also be utilized as a substitute for timber fascias and bargeboards, especially in high fire risk or prone areas.

Siding or cladding materials, due to the material cost or manufacturing methods, are often thin and typically brittle or fragile. The thin nature of siding and cladding materials results in the siding materials conforming to the planar conditions of the framing. This can result in building stress into the applied panel. In addition to fiber cement, thin panels may be formed from laminated and composite wood materials, and panels formed from polymer resins. Siding materials can also be formed from steel, aluminum and ultra violet light resistant polyvinyl chloride. Despite the fragile nature of the aforementioned siding materials, attachment studs with widths that typically range from between 1¼-inch to 2-inches provide a very small 'target' to match and align the butt ends of the panels formed from the siding materials. With thicker, less brittle panels, such as cedar siding, a nail or screw can be installed at an angle into the stud, minimizing the problems created by the narrow stud; however, this cannot be done consistently with thinner and brittle panels. When securing panels to a stud, if a stud is out of alignment or the panel has been mis-cut, there is insufficient bearing for the two panels to be secured to a single stud. The problem is compounded by the thin nature of the panel and the need for the head of the fastener to be flush with the surface of the panel, which in some situations requires the use of a countersunk head screw, typically with 'burrs' or 'wings' under the head to bore into the relatively hard and brittle panel to sink the head flush with the panel surface. The boring weakens the panel at a critical point since the butt edge attachment is very close to the edge.

The problems associated with the thin and brittle nature of certain panels are compounded when attached to a series of studs in a frame that are not planer. When a stud is not planer to panel, there is additional stress as two adjoining panel members are forced into alignment, which creates stress at both panel edges of the adjoined panels. Furthermore, even if a stud is planer to the outer face, the face of the stud can be damaged creating a point of attachment that is out of plane. By loading the end of the panel and drawing the panel out of plane, the panel will, over time, likely crack due to the loads created by pushing or pulling the panel to the misaligned stud. If the butt end of the panel is supported by the stud by only a fraction of an inch (a common occurrence) the nail or screw must be installed at an angle, creating further stress on the panel and resulting in cracking. Where wood studs are used, fasteners may be installed at angles to compensate for misalignment. However, for studs that are steel or made of composite materials, fasteners must enter perpendicular to the point of attachment to allow the fastener to drill or penetrate the substrate material.

Finally, to accommodate for material expansion, panel manufacturers often require gapping of the panels of approximately 1/16-inch or moderate contact of the edges, achieving such gapping is time consuming and labor intensive for installers. The expansion gap between panels further reduces the area on a panel for attachment to a stud, which creates greater problems achieving an adequate surface for attachment. For a perfect 'marriage' of the butt ends, the panel ends must be cut perfectly at a ninety degree angle in the field, which is not always achieved, creating a gap between the two panel edges, again reducing the target area of attachment for at least two panels on a single stud. The reduced area available for attachment requires screw head sizes that must be smaller to minimize the area of 'boring' into the panel surface to set the screw flush. Since the screw must be a minimum distance offset from the panel edge, the size of the screw head must remain small. Typical screw head sizes are 0.330 to 0.450-inches.

Thus, there exists a need for a joiner plate or clip that assists in installing and securing panels to a frame and the improves ease, efficiency, and accuracy of placement, spacing, and alignment of panels when creating butt joints and required gapping during installation. There also exists a need for a joiner clip capable of securing panels to a stud without weakening or compromising the panels.

SUMMARY OF THE INVENTION

A joiner clip for securing panels to a substrate is provided that includes a sheet of material that has a first portion and a second portion along with a first face and a second face. The sheet of material is planar or slightly curved and capable to flexing to a planar configuration. A first pointed anchoring cleat is located in the first portion of the sheet on the first face. A second pointed anchoring cleat is located in the second portion of the sheet on the first face. The first face also includes a spaced guide that is positioned between the first portion and the second portion of the sheet. A mounting hole is formed through the sheet and is positioned colinear with the spacer guide.

A construction unit is also provided with panels of material secured by the anchoring cleats and spaced apart by the spacer guide of such a joiner clip. The joiner clip and panels are secured to a vertical stud substrate by a fastener that is received by the joiner clip from the second face and that passes through the joiner clip into the stud substrate. A joint is readily formed between two secured panels.

DETAILED DESCRIPTION OF THE PREFERRED EMBODIMENTS

Figure 1:
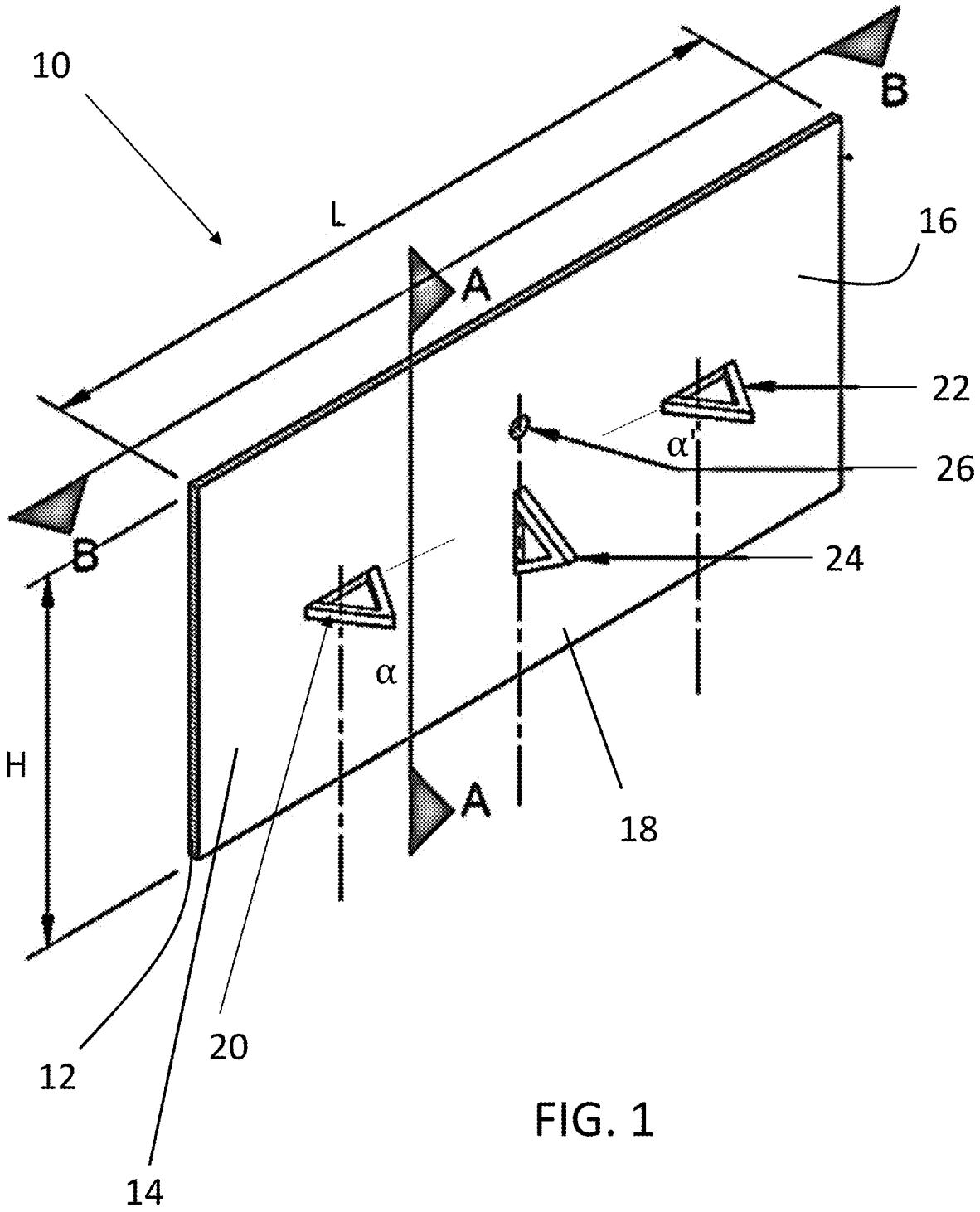
FIG. 1 is a perspective view of a joiner clip according to a form of the present invention.

The present invention has utility as a joiner clip to form a construction unit that assists in installing and securing panels to a frame and is designed to improve ease, efficiency, and accuracy of placement, spacing, and alignment of panels when creating butt joints during installation while also protecting the panels from being weakened or compromised by the fastener. The joiner clip of the present invention creates a larger bearing surface at the critical joint connection between two panels, thereby increasing wind load resistance in the areas of the panels that typically fail when held in place by prior art solutions such as screws alone. As used herein, the terms "joiner plate" and "joiner clip" are used synonymously. Embodiments of the inventive joiner plate or clip increase speed in panel or siding installation by minimizing re-cutting due to variations in studs and provides for an accurate and consistent spacing between panels during installation. The inventive joiner plate also reduces the number of fasteners needed to secure multiple panels to a stud, which reduces overall material costs and installation time.

In certain embodiments, a rainscreen batten for creating a water-resistant barrier and for spacing the panels from the underlying stud in a non-planar orientation is positioned between the vertical stud and the panels secured thereto. Embodiments of the inventive joiner plate may be used for substrates such as wood, metal, alloy, and steel studs.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Embodiments of the on-stud attachment joiner plate or clip provide for even support of panels with a broad attachment base. The broad attachment base allows for a reduction in the number of joiner plates or hangers for a given length of panel, thereby requiring less labor and installation time. The broad attachment base provided by embodiments of the inventive joiner, in contrast to the thinner attachment surface of a traditional stud, allows for an increased screw head size (versus traditional sizes in the range of 0.330 to 0.450-inches). The larger screw head creates greater holding power (rupture over the panel) and a greater wind load resistance with a single fastener. The joiner clip of the present disclosure accordingly only requires the use of a single fastener to secure the ends of two separate panels, whereas prior art solutions required the use of a separate screw for each end of a panel. Accordingly, the number of screws required to secure the same number of panels is reduced by half when using the joiner clip of the present disclosure. The reduction in the number of screw fasteners contributes to less potential damage to the panel and saves time and labor with less fastening. The inventive joiner clip also provides a significant performance increase in terms of traction. For example, using an inventive joiner clip to secure a 7.25 inch wide panel to a stud and subjecting the panel to an e-330 test, the ultimate load is 148 psf versus the ultimate load of 126 psf for the same panel secured to a stud at its edge using a nail. Accordingly, the inventive joiner clip provides at least a 17% increase in performance.

The inventive joiner plate acting as an attachment or bearing plate for panels can be attached to a stud with one or two screws, depending on the size of the panels and the wind load requirements for the project. From an aesthetic point of view, the larger area of attachment also allows the installer to create an even pattern of joiner plate attachments instead of forcing fasteners in at the corners that are not pleasing.

Furthermore, the broad attachment area of the inventive joiner clip allows for screws or other fasteners to always be installed perpendicular to the joiner plate steel. The screw will enter the joiner plate without skidding and will create maximum holding power while not stressing the panel. Attachment at extreme edges of the panel that weakens the panel with traditional studs is eliminated with the inventive joiner.

The panel is properly aligned, vertically, by the spacer guide and anchoring cleats. The anchoring cleats properly align the panels and assist to hold the panels in place prior to attachment of the joiner clip to the stud. Once the fastener penetrates the stud, the joiner clip draws the panels to the stud and the joiner plate to the panels. This assists in reducing stress when a stud is out of alignment and creates a larger bearing surface at the front of the panel to create greater support.

The flat face of the joiner clip creates an excellent surface to mate the two panel edges. The outer edges and surfaces of the joined panels will always be in plane, eliminating shadow lines, voids, and out of plane edges. The joining clip can be formed in various sizes to address any size lap panel with any predetermined overlap. The joining plate can be pre-colored to match pre-painted siding or can be formed from paint grip or bonderized metal that will easily take paint. The gauge or thickness of joiner plate can be reduced by adding stiffening ribs running perpendicular with the studs.

Embodiments of the joiner clip can adjust to accommodate minor planar stud deviations in the frame support. The joiner clip does not need to be perfectly aligned on the stud, since the large bearing surface creates room for adjustment. The joiner clip can be offset to compensate for a stud that is spaced or sized irregularly. The correction of minor stud deviations reduces load protection and therefore stress on attached panels such as cement panels. Furthermore, embodiments of the joiner clip are thin enough to 'move' to create a snug connection with panels including fiber cement, yet strong enough to transfer the load through the fastener to the steel or wood stud, thereby creating an immediate correction.

Figure 2:
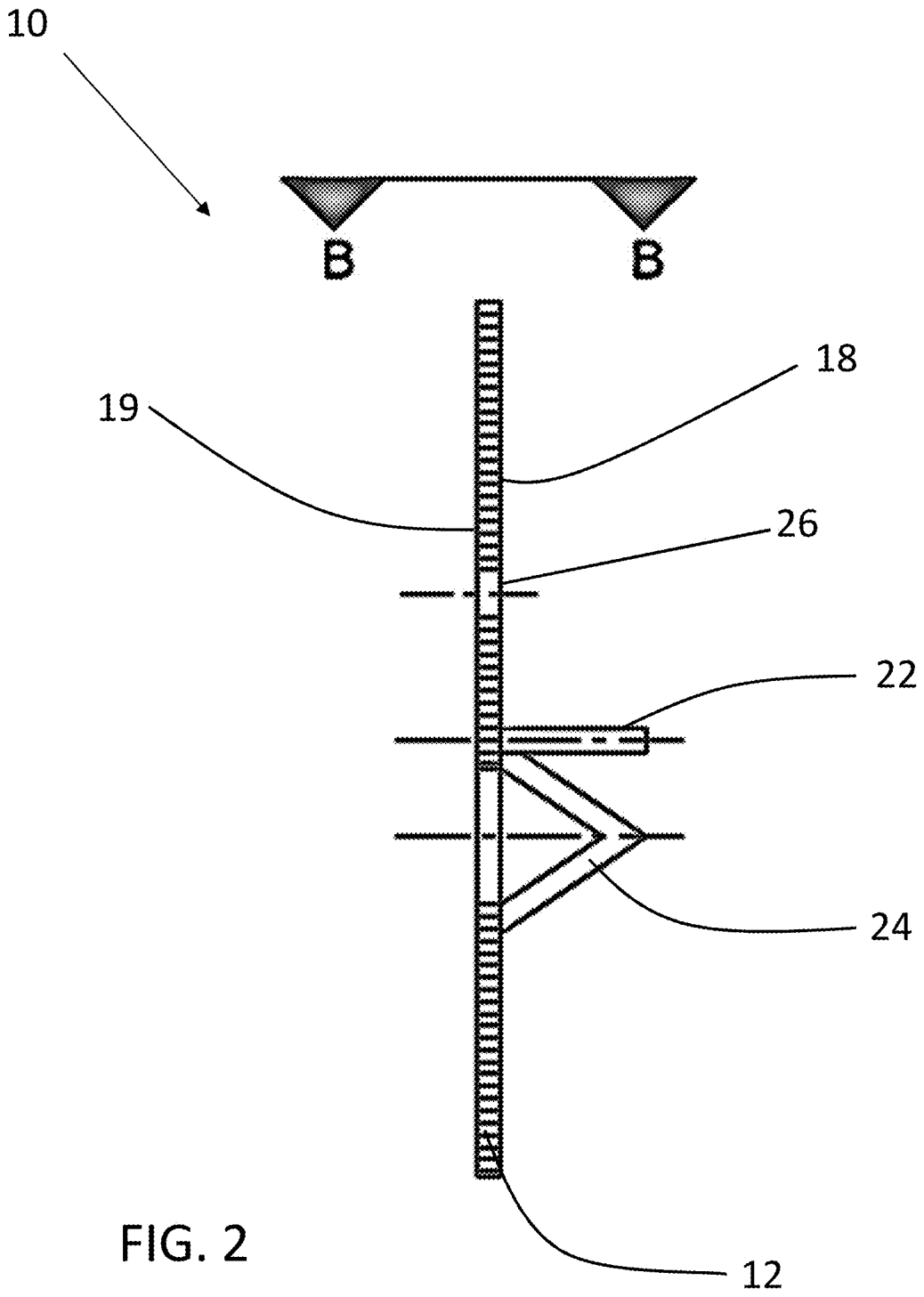
FIG. 2 is a cross-sectional side view of the joiner clip of FIG. 1 along line A-A.
Figure 3A:
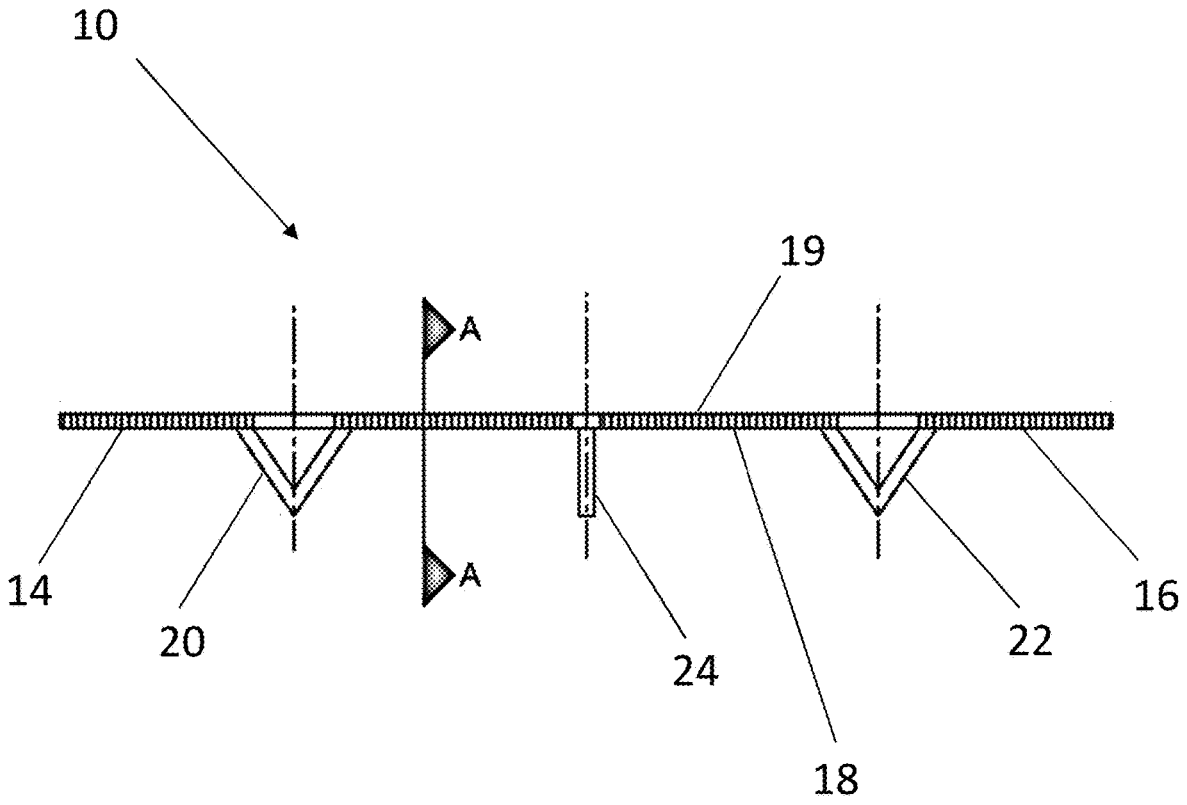
FIG. 3A is a top view of the joiner clip of FIG. 1 along line B-B.
Figure 3B:
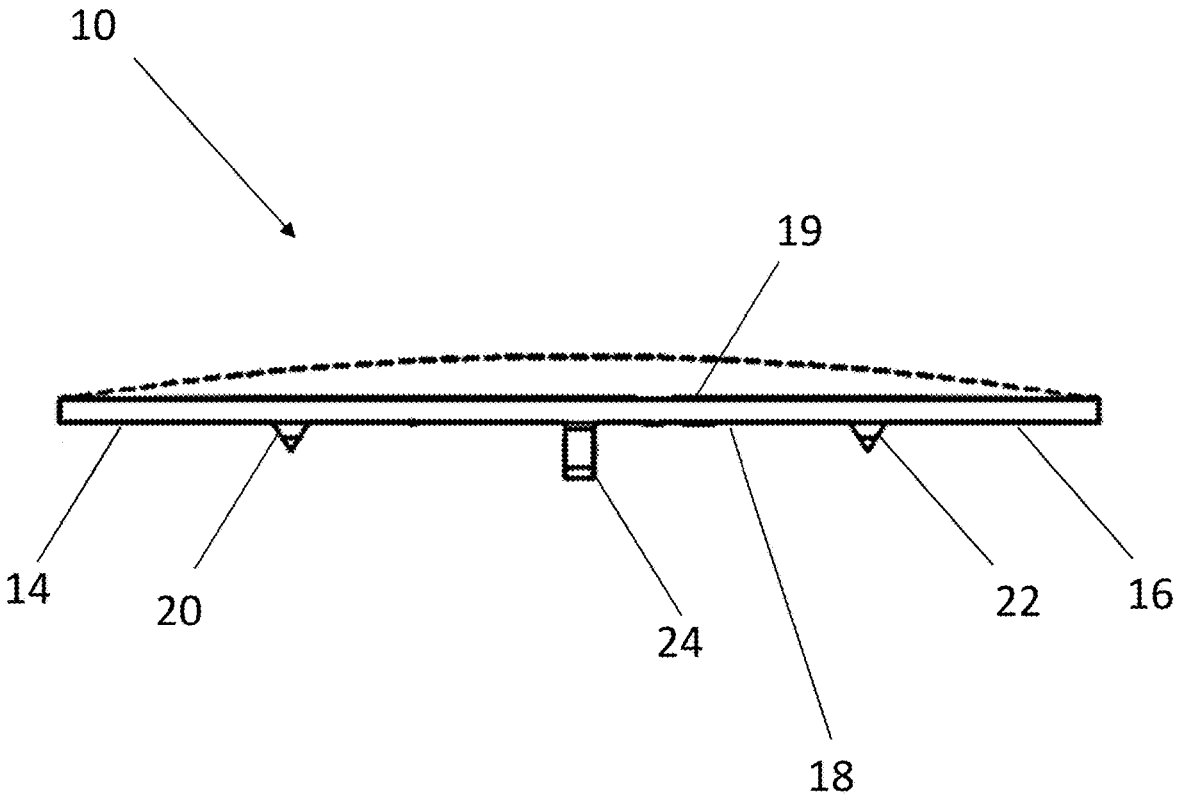
FIG. 3B is a top view of a joiner clip according to a form of the present disclosure.

With reference to the attached figures, an inventive joiner plate or clip is depicted generally at 10. As shown in FIGS. 1-3, the joiner plate 10 is generally formed from a sheet of material 12 composed of metal; metal alloys; plastic; fiber reinforced resins of fiberglass or carbon fiber; or other composite materials. In an embodiment the joiner plate 10 may be formed from 16 gauge to 20 gauge, G-90 galvanized or galvalume metal, or 16 gauge to 26 gauge galvanized paintgrip/bonderized for painting of the joiner plate surface or stainless steel 304 and 316. According to embodiments, the sheet of material 12 is planar. In various embodiments the sheet of material 12 is slightly curved in its natural, non-use state, as shown by the dotted line in FIG. 3B. Such curved sheet 12 joiner clips are configured to flex to a planar configuration when in use with panels to be joined. As used herein, the term "planar" means in the form of a plane and includes both sheets 12 that are permanently planar and those that are curved in a non-use state and capable of flexing to a planar configuration during use. The joiner plate 10 includes a first portion 14 and a second portion 16. According to some embodiments, the first portion 14 and second portion 16 can be thought of as the right half and the left, respectively, of the joiner clip 10. The joiner clip 10 shown in FIG. 1 also includes a first face 18 and an oppositely opposed second face 19 on the reverse side of the first face 18, which is therefore not shown in FIG. 1. According to embodiments, both the first face 18 and the second face 19 are generally planar to allow smooth planar contact with panels and mounting substrates, respectively.

The joiner clip 10 further includes a first anchoring cleat 20 and a second anchoring cleat 22. Both the first anchoring cleat 20 and the second anchoring cleat 22 are disposed on the first face 18, with the first anchoring cleat 20 being within the first portion 14 and the second anchoring cleat 22 being within the second portion 16 of the planar sheet 12 of the joiner clip 10. While each of the first anchoring cleat 20 and a second anchoring cleat 22 are shown for visual clarity as single cleats, each of the cleats 20 and 22 can independently include additional cleats that are displaced horizontally, vertically, or a combination thereof relative to those depicted in FIG. 1. These duplicate cleats are not shown for visual clarity, yet provide for increased joinder strength, compared to that depicted in FIG. 1. It is appreciated that duplicate cleats of either cleats 20 or 22 can each protrude to the same extent or a different extent than those depicted in FIG. 1.

The first and second anchoring cleats 20, 22 form a first point and a second point, respectively, on the first face of the planar sheet 12 of the joiner clip 10. The points are readily formed by cutting parallel slits and punching the intermediate out of the basal plane of the sheet 12. According to some embodiments, the first anchoring cleat 20 is in-line with, or synonymously referred to herein as colinear with, the second anchoring cleat 22 and the spacer guide 24, as shown in FIG. 1, while in other embodiments, the anchoring cleats 20, 22 are positioned such that they are offset linearly from one another. In some embodiments, the first anchoring cleat 20 and the second anchoring cleat 22 are equally spaced from a spacer guide 24 (described in further detail below) as shown in FIG. 1, while in other embodiments one of the first or second anchoring cleats 20, 22 is spaced farther from the spacer guide 24 than the other. According to various embodiments, the first and second anchoring cleats 20, 22 are separate features that are attached to or passed through the planar sheet 12, for example nails, hooks, or barbs. In some embodiments, the first anchoring cleat 20 and the second anchoring cleat 22 are integrally formed with the planar sheet 12, for example by punching the anchoring cleats 20, 22 into the planar sheet 12 from the side of the second face 19 such that the first and second points of the first and second anchoring cleats protrude from the first face 18 of the planar sheet 12. It is appreciated that while the angular displacement between the anchoring cleats 20 and 22, a and a' and the spacer guide is depicted as being perpendicular in FIG. 1, these angular displacements each vary independently between 0 and 180 degrees and in some embodiments, a is between 70 and 110 degrees.

The joiner clip 10 also includes a spacer guide 24 disposed on the first face 18 of the planar sheet 12 of the joiner clip 10. The spacer guide 24 is positioned on the first face 18 between the first portion 14 and second portion 16 of the planar sheet 12. According to some embodiments, the spacer guide 24 is a separate feature that is attached to the planar sheet 12, while in other embodiments, the spacer guide 24 is integrally formed with the planar sheet 12, for example by punching. According to some embodiments, the spacer guide 24 is oriented perpendicularly to the first anchoring cleat 20 and second anchoring cleat 22. The spacer guide 24.

A mounting hole 26 is formed through the planar sheet 12 of the joiner clip 10. The mounting hole 26 is a through hole configured to receive a fastener. The mounting hole 26 is positioned between the first portion 14 and second portion 16 of the planar sheet 12 and is in line with the spacer guide 24. According to some embodiments, the joiner clip 10 includes a plurality of mounting holes formed through the planar sheet 12, which are also in line with the spacer guide 24. According to various embodiments, the mounting hole 26 is pressed or drilled into the planar sheet 12.

The dimensions of the joiner clip 10 can be varied based on various use conditions and requirements. According to various embodiments, the overall length L of the planar sheet is 1.5 to 3 inches long thereby providing a broad attachment base for the panels that allows for a reduction in precision required in cutting the panels and lining them up precisely with the substrate, thereby requiring less labor and installation time. According to various embodiments, the overall height H of the planar sheet is and 0.5 to 2 inches in height. Preferably the planar sheet is 2.25 inches long and 1.125 inches high. In some embodiments, the first and second anchoring cleats 20, 22 are 0.25 inches long, however it is to be understood that the two anchoring cleats need not be the same dimensions. According to various embodiments, the anchoring cleats 20, 22 protrude from the first face 18 at least 0.125 inches. In some embodiments, the anchoring cleats 20, 22 are spaced at least 0.5 inches from the spacer guide 24, creating a wide point of attachment and keeping the panel attachment away from the edges, thereby reducing cracking of the panels 30. In some embodiments, the mounting hole is colinearly spaced apart from the spacer guide 24 by at least 0.125 inches.

Figure 4:
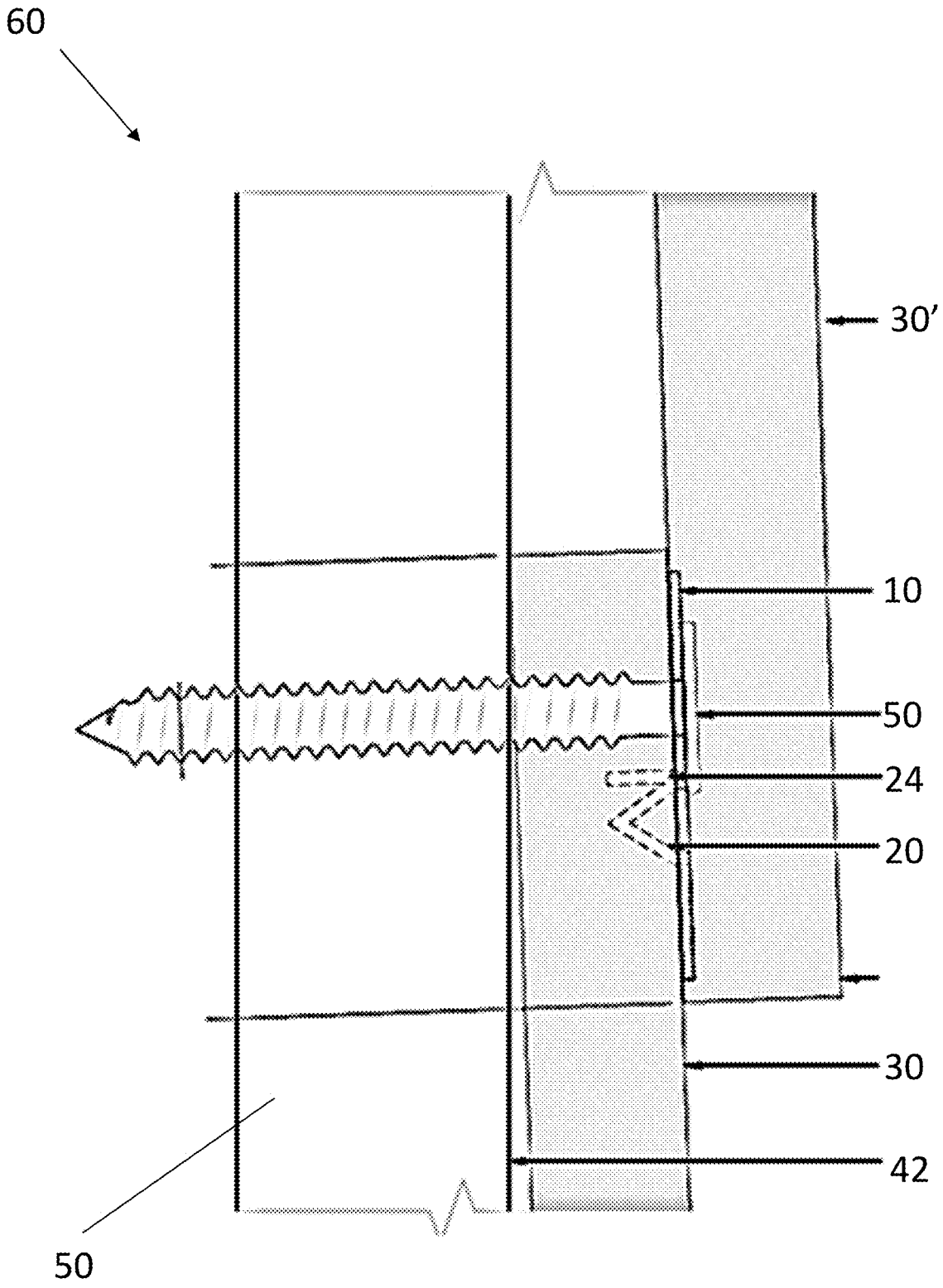
FIG. 4 is a cross-sectional side view of a joiner clip and a panel secured to a stud by a fastener according to a form of the present disclosure.
Figure 5:
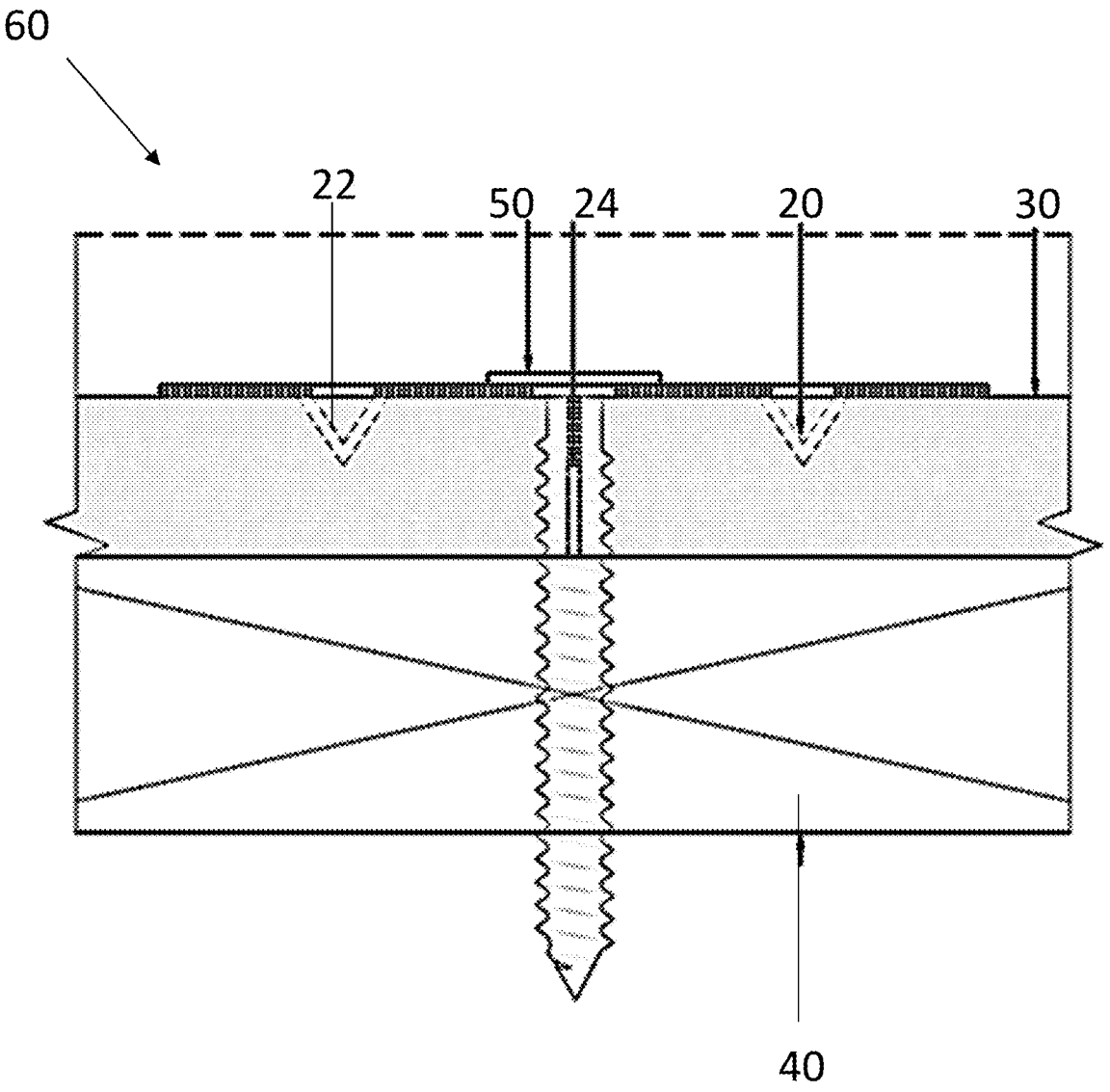
FIG. 5 is a cross-sectional top view of a joiner clip and a panel secured to a stud by a fastener according to a form of the present disclosure.
Figure 6:
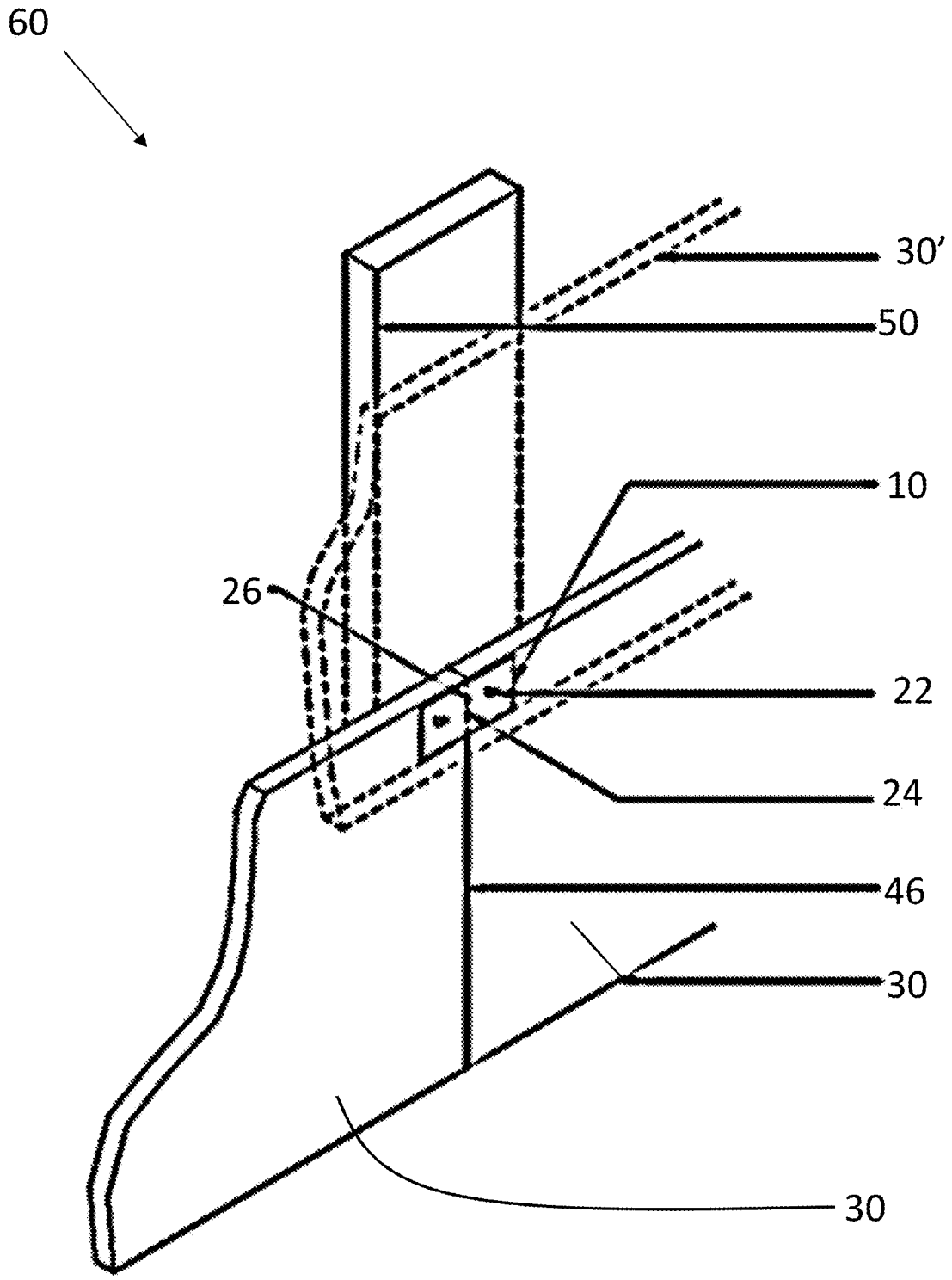
FIG. 6 is a perspective view of a construction unit according to a form of the present disclosure.

As shown in FIGS. 4-6, the joiner clip 10 is configured to secure panels 30 to a substrate 40. According to some embodiments, the panels 30 are fiber cement panels. In some embodiments, the substrate 40 is stud. The joiner clip 10 is designed such that the point of the first anchoring cleat 20 pierces a first panel 30 and the point of the second anchoring cleat 22 pierces a second panel 30, thereby preventing the panels 30 from slipping out of position. The spacer guide 24 is configured to be positioned between the first and second panels 30. The spacer guide 24 provides the required gapping between two panels 30 to allow for expansion of the panel while also ensuring that the panels are equally spaced for aesthetic purposes. The spacer guide 24 also creates a butt joint 46 between two panels 30 with little effort from a user and with litter error.

In installation, two panels 30 are posited relative to the substrate 40. The joiner clip 10 is then positioned relative to the panels 30 with the first anchoring cleat 20 piercing the first panel 30 and the second anchoring cleat 22 piercing the second panel 30. The spacer guide 24 is positioned between the two panels to properly gap the panels 30. The joiner clip 10, vertical stud substrate 40, and a first and second panel 30 define a construction unit 60 according to embodiments of the present disclosure. In embodiments where the sheet 12 is slightly curved as shown in FIG. 3B, the sheet 12 is forced into a planar configuration when the cleats 20, 22 pierce the panels 30, creating an internal tension within the sheet 12 to revert to its naturally curved position. This internal tension acts on the panels through the cleats 20, 22 and draws the panels toward each other. A fastener 50 is then inserted into the mounting hole 26 from the side of the second face 19 of the joiner clip 10. The fastener 50 penetrates the substrate 40 thereby securing both panels 30 to the substrate 40. The fastener 50 may be pre-set in the mounting hole 26. In some embodiments, number ten or number twelve (#10 or #12) pancake or wafer head screws are used in conjunction with the joiner plate 10. The (#10 or #12) pancake or wafer head screws provide a minimum withdrawal resistance in 33 KSI 24 ga. galvanized steel of not less than 2501 bf.

Given that the mounting hole 26 is colinear with the spacer guide 24, the fastener generally passes through the gap between the panels that is created by the spacer guide 24. The force of tightening the fastener 50 into the underlying substrate 40 is dispersed along the planar sheet 12, pulling the panels 30 into secure position against the substrate 40. Because the head of the fastener 50 is in contact with the second face 19 of the joiner clip 10, the panels 30 that are secured to the substrate are protected from damage by the fastener. As shown in FIG. 4, some embodiments of a construction unit 60 include a siding strip 42 or vertical rainscreen batten that is secured to the substrate 40 beneath the panels 30. According to various embodiments, additional panels 30' are layered upon the panels 30 and cover the joiner clip 30 and fastener 50.

Any patents or publications mentioned in this specification are herein incorporated by reference to the same extent as if each individual publication was specifically and individually indicated to be incorporated by reference.

The foregoing description is illustrative of particular embodiments of the invention, but is not meant to be a limitation upon the practice thereof.

The invention claimed is:

1. A joiner clip for securing panels to a substrate, said joiner clip comprising:

a sheet of material, having a first portion, a second portion, a first face, and an oppositely opposed second face;

a first anchoring cleat defined between two parallel through slits disposed in the first portion of said sheet and punched from first anchoring cleat material intermediate between the two parallel slits out of a basal plane defined by said sheet, said first anchoring cleat forming a first point protruding from the first face of said sheet;

a second anchoring cleat defined between two parallel through slits disposed in the second portion of said sheet and punched from second anchoring cleat material intermediate between the two parallel slits out of the basal plane defined by said sheet, said second anchoring cleat forming a second point protruding from the first face of said sheet; and a spacer guide defined between two parallel through slits protruding from the first face of said sheet and punched from space guide material intermediate between the two parallel slits out of the basal plane defined by said sheet, said spacer guide positioned between the first portion and the second portion of said sheet.

2. The joiner clip of claim 1 wherein the first point of said first anchoring cleat is configured to pierce a first panel, the second point of said second anchoring cleat is configured to pierce a second panel, and said spacer guide is configured to be positioned between the first panel and the second panel.

3. The joiner clip of claim 2 wherein said spacer guide creates a butt joint gap between the first panel and the second panel.

4. The joiner clip of claim 1 wherein said first anchoring cleat and said second anchoring cleat are integrally formed on said sheet.

5. The joiner clip of claim 1 wherein said spacer guide is integrally formed on said sheet.

6. The joiner clip of claim 1 wherein said first anchoring cleat and said second anchoring cleat are colinear.

7. The joiner clip of claim 1 wherein said spacer guide is positioned at an angle $\alpha$ of between 70 and 110 degrees relative to said first anchoring cleat.

8. The joiner clip of claim 1 further comprising a mounting hole formed through said sheet, said mounting hole positioned colinear with said spacer guide.

9. The joiner clip of claim 1 wherein said sheet of material is a metal, alloy, plastic, or fiber reinforced resin.

10. The joiner clip of claim 1 wherein said sheet is 16-26 gauge galvanized metal.

11. The joiner clip of claim 1 wherein said sheet is galvalume metal.

12. The joiner clip of claim 1 wherein said sheet is galvanized paintgrip, galvanized bonderized, or a combination thereof.

13. The joiner clip of claim 1 wherein at least one of said first and said second anchoring cleats is punched into said sheet.

14. The joiner clip of claim 1 wherein said spacer guide is punched into said sheet.

15. The joiner clip of claim 1 wherein the panels are fiber cement panels.

16. The joiner clip of claim 1 wherein the substrate is a stud.

17. The joiner clip of claim 1 wherein the sheet is planar.

18. The joiner clip of claim 1 wherein the sheet is curved in an un-used state and configured to be planar in use.

19. A construction unit comprising:

a vertical stud substrate;

a joiner clip for securing panels to the substrate comprising: a sheet of material, having a first portion, a second portion, a first face, and an oppositely opposed second face; a first anchoring cleat defined between two parallel through slits disposed in the first portion of said sheet formed by punching first anchoring cleat material intermediate between the two parallel slits out of a basal plane defined by said sheet, said first anchoring cleat forming a first point protruding from the first face of said sheet; a second anchoring cleat defined between two parallel through slits disposed in the second portion of said sheet, said second anchoring cleat forming a second point protruding from the first face of said sheet formed by punching second anchoring cleat material intermediate between the two parallel slits out of the basal plane defined by said sheet; a spacer guide defined between two parallel through slits protruding from the first face of said sheet formed by punching space guide material intermediate between the two parallel slits out of the basal plane defined by said sheet, said spacer guide positioned between the first portion and the second portion of said sheet; and a mounting hole formed through said sheet, said mounting hole positioned colinear with said spacer guide; and a first panel and a second panel, said first panel pierced by the first point of the first anchoring cleat, said second panel pierced by the second point of the second anchoring cleat, and the spacer guide positioned between the first panel and the second panel.

20. The unit of claim 19 further comprising a fastener extending through the mounting hole in said joiner clip from the second face of the sheet into the substrate to secure said first panel and said second panel to said substrate.

21. The unit of claim 19 further comprising a siding strip secured to said substrate beneath said first panel and said second panel.

* * * * *